US007281576B2

(12) United States Patent
Curtice et al.

(10) Patent No.: US 7,281,576 B2
(45) Date of Patent: Oct. 16, 2007

(54) APPARATUS AND METHODS FOR SEALING VOIDS IN A SUBTERRANEAN FORMATION

(75) Inventors: Richard J. Curtice, Vernal, UT (US); Gregory D. Wilcox, Wooster, OH (US); Len E. Fry, Butler, OH (US)

(73) Assignee: Halliburton Energy Services, Inc., Duncan, OK (US)

( * ) Notice: Subject to any disclaimer, the term of this patent is extended or adjusted under 35 U.S.C. 154(b) by 217 days.

(21) Appl. No.: 10/800,157

(22) Filed: Mar. 12, 2004

(65) Prior Publication Data

US 2005/0199390 A1 Sep. 15, 2005

(51) Int. Cl.
*E21B 33/13* (2006.01)

(52) U.S. Cl. ..... 166/250.14

(58) Field of Classification Search ..... None
See application file for complete search history.

(56) References Cited

U.S. PATENT DOCUMENTS

| | | | | |
|---|---|---|---|---|
| 3,415,318 A | | 12/1968 | Meijs | |
| 3,448,800 A | | 6/1969 | Parker et al. | 166/294 |
| 4,064,941 A | | 12/1977 | Smith | 166/300 |
| 4,286,900 A | | 9/1981 | Sugimoto et al. | 405/269 |
| 4,449,856 A | | 5/1984 | Tokoro et al. | 405/269 |
| 5,006,017 A | | 4/1991 | Yoshida et al. | 405/263 |
| 5,103,908 A | * | 4/1992 | Allen | 166/285 |
| 5,343,968 A | | 9/1994 | Glowka | 175/231 |
| 5,570,743 A | * | 11/1996 | Padgett et al. | 166/285 |
| 5,577,865 A | | 11/1996 | Manrique et al. | 405/266 |
| 5,582,251 A | | 12/1996 | Bailey et al. | 166/286 |
| 5,645,375 A | * | 7/1997 | Stephens | 405/146 |
| 5,980,446 A | | 11/1999 | Loomis et al. | 588/250 |
| 6,257,803 B1 | | 7/2001 | McCabe et al. | 405/269 |
| 6,451,104 B2 | * | 9/2002 | Mehta | 106/705 |
| 6,497,290 B1 | | 12/2002 | Misselbrook et al. | 166/384 |

OTHER PUBLICATIONS

Foreign communication from a related counterpart application dated Mar. 29, 2005.

* cited by examiner

*Primary Examiner*—Jennifer H. Gay
*Assistant Examiner*—Kerry W. Leonard
(74) *Attorney, Agent, or Firm*—John W. Wustenberg; Baker Botts, L.L.P.

(57) ABSTRACT

Downhole tools that include an outer tubing disposed around an inner tubing for placement of a sealant mixture into a void in a subterranean formation and associated methods of use are provided. Furthermore, a method is provided for preparing a cement composition, which includes mixing a first cementitious component and an aqueous-based fluid in a first mixer to form an intermediate cement composition, and mixing the intermediate cement composition and a second cementitious component in a second mixer to form the cement composition.

38 Claims, 3 Drawing Sheets

APPARATUS AND METHODS FOR SEALING VOIDS IN A SUBTERRANEAN FORMATION

BACKGROUND OF THE INVENTION

The present invention relates generally to apparatus and methods for sealing voids in a subterranean formation, and more particularly, the present invention relates to downhole tools that employ an outer tubing disposed around an inner tubing for placement of a sealant mixture into a void in a subterranean formation.

Sealant mixtures are commonly used in subterranean operations. Sealant mixtures may be used to seal voids in subterranean formations for a variety of reasons, such as to provide zonal isolation or to seal a lost circulation zone. For example, a sealant mixture may be used to form a seal in a void in a subterranean formation that prevents the undesirable migration of fluids between zones. Furthermore, sealant mixtures may be used for sealing abandoned underground voids, such as mineshafts, depleted wells, and the like. Sealant mixtures may also be used to seal a void, such as a mineshaft or mine entry, to suffocate and/or aid in putting out a coal fire.

One example of a sealant mixture commonly used in subterranean operations is a flowable cement composition. Flowable cement compositions generally comprise an aqueous-based fluid and hydraulic cement. Blends of hydraulic cement with fly ash, such as "POZMIX®" cement, may also be used. POZMIX® cement is an ASTM Class F fly ash cement that is commercially available from Halliburton Energy Services, Duncan, Okla. Generally, these flowable cement compositions are delivered to a void in the subterranean formation and allowed to set, thereby forming the desired seal. The use of these flowable cement compositions, however, may be problematic. For example, because these cement compositions are flowable considerable amounts of them may be wasted by flow into vugular porosity, natural fractures, weak formations, and other undesirable areas besides the desired void to be sealed. To account for the amounts of the flowable cement compositions wasted by flow into these undesirable areas, an excess volume of the flowable cement composition may be used. But this may add considerable expense due to the excess material needed and add additional uncertainty due to inaccuracies in determining the amount of excess material needed to account for the undesirable flow off.

To counteract these problems associated with flowable cement compositions, substantially non-flowable cement compositions may be used. Substantially non-flowable cement compositions generally comprise an aqueous-based fluid, hydraulic cement, and an activator (e.g., sodium silicate). Blends of hydraulic cement with fly ash may also be used. By using substantially non-flowable cement compositions, the waste and uncertainties associated with flowable cement compositions may be reduced, inter alia, because the substantially non-flowable cement composition does not flow away from the area of placement. Instead, the non-flowable cement composition begins to harden after placement without flow to undesirable areas.

A number of techniques have been developed for mixing and delivering the substantially non-flowable cement compositions into the desired location within the subterranean formation. In one such method, the components of the substantially non-flowable cement composition are first mixed on the surface. Next, the substantially non-flowable cement composition may be placed into the subterranean formation by pumping it through a delivery means (e.g., a conduit, a tube, or a pipe) to the opening of the void to be sealed for free-fall placement therein. However, pumping the substantially non-flowable cement composition into the subterranean formation may be problematic, inter alia, due to the pumping requirements associated with pumping this composition through the delivery means.

Another technique for mixing and delivering the substantially non-flowable cement composition to the desired location in the subterranean formation involves utilization of a two component system, whereby the two components of the substantially non-flowable cement composition are mixed downhole to form the desired composition. The first component generally may comprise an activator, and the second component generally may comprise a flowable cement composition, such as those described above. Alternatively, the second component may comprise the activator, and the first component may comprise the flowable cement composition. Shown in FIG. 1 is one such prior art technique for delivery of the substantially non-flowable cement composition to the desired location, e.g., void 100 in subterranean formation 102. This technique involves placing downhole tool 104 comprising tubing 106 into borehole 108 penetrating subterranean formation 102. Tubing 106 may be bull plugged (not shown) with a plurality of ports 110 disposed in the bull plug. In addition, borehole 108 may be lined with casing 112, which extends from the ground surface (not shown) into borehole 108 and terminates above void 100. Casing 112 may be cemented to subterranean formation 102 by cement sheath 114. Annulus 116 is formed between casing 112 and tubing 106. Furthermore, casing 112 should extend beyond tubing 106, forming mixing chamber 118 between the bottom end of tubing 106 and the bottom end of casing 112. In operation, the two components of the substantially non-flowable cement composition are delivered downhole simultaneously. First component 120 may be delivered down through tubing 106, out through ports 110, and into mixing chamber 118. Second component 122 may be delivered down through annulus 116 into mixing chamber 118. In mixing chamber 118, the two components combine to form the substantially non-flowable cement composition. After mixing, the substantially non-flowable cement composition is delivered to void 100 by free-fall drop from mixing chamber 118. Once delivered, the substantially non-flowable cement composition hardens to form a seal.

However, this technique has drawbacks. For instance, large volumes of the substantially non-flowable cement composition may be required because of imprecision in placing such composition in the desired location within the subterranean formation. Moreover, the borehole may no longer be in a usable state after formation of the seal due to plugging of the borehole by the seal. Additional problems may be encountered where the borehole is not centrally aligned over the center of the desired location, such as a mineshaft. This may result, inter alia, in premature sealing of the borehole prior to the sealing of the mineshaft.

SUMMARY OF THE INVENTION

The present invention relates generally to apparatus and methods for sealing voids in a subterranean formation, and more particularly, the present invention relates to downhole tools that employ an outer tubing disposed around an inner tubing for placement of a sealant mixture into a void in a subterranean formation.

Some embodiments of the present invention provide a downhole tool for sealing a void in a subterranean formation that includes an inner tubing having at least one port disposed at a bottom end through which a first component of a sealant mixture is delivered downhole. The downhole tool further includes an outer tubing disposed around the inner tubing thereby forming an annulus therebetween through which a second component of the sealant mixture is delivered downhole. The outer tubing having a closed bottom end which extends below the bottom end of the inner tubing. The downhole tool further includes a mixing chamber formed between the bottom end of the inner tubing and the bottom end of the outer tubing into which the first and second components of the sealant mixture combine to form the sealant mixture. And the downhole tool further includes at least one discharge port formed at the bottom end of the outer tubing for discharging the sealant mixture from the mixing chamber.

In one aspect, the downhole tool according to the present invention includes a means for orientating the downhole tool in a borehole. In one embodiment, the orientation means comprises a large latch ring attached to the outer tubing, a small latch ring attached to the large latch ring, and a rod inserted into the small latch ring. The rod inserted into the small latch ring extending from at least a top end of the downhole tool to a top edge of the at least one discharge port.

Another embodiment of the present invention includes a method of sealing a void in a subterranean formation. The method includes pumping a first component of a sealant mixture through an inner tubing, the inner tubing having at least one port disposed at a bottom end through which the first component is discharged downhole from the inner tubing. The method further includes pumping a second component of the sealant mixture through an annulus formed between an outer tubing disposed around the inner tubing, wherein the annulus delivers the second component of the sealant mixture downhole. The method further includes combining the first component of the sealant mixture and the second component of the sealant mixture in a mixing chamber formed between the bottom end of the inner tubing and a closed bottom end of the outer tubing, which extends below the bottom end of the inner tubing. And the method further includes discharging the sealant mixture from the mixing chamber into the void.

Another embodiment of the present invention includes a method of sealing a void in a subterranean formation. The method includes providing a first component of a sealant mixture. The method further includes mixing a first cementitious component and an aqueous-based fluid in a first mixer to form an intermediate cement composition. The method further includes mixing the intermediate cement composition and a second cementitious component in a second mixer to form a second component of the sealant mixture. The method further includes pumping the first component of the sealant mixture through an inner tubing, the inner tubing having at least one port disposed at a bottom end through which the first component is discharged downhole from the inner tubing. The method further includes pumping the second component of the sealant mixture through an annulus formed between an outer tubing disposed around the inner tubing, wherein the annulus delivers the second component of the sealant mixture downhole. The method further includes combining the first component of the sealant mixture and the second component of the sealant mixture in a mixing chamber formed between the bottom end of the inner tubing and a closed bottom end of the outer tubing, which extends below the bottom end of the inner tubing. And the method further includes discharging the sealant mixture from the mixing chamber into the void.

Another embodiment of the present invention includes a method of sealing a void in a subterranean formation. The method includes mixing a first cementitious component and an aqueous-based fluid in a first mixer to form an intermediate cement composition. The method further includes mixing the intermediate cement composition and a second cementitious component in a second mixer to form a first component of a sealant mixture. The method further includes pumping the first component of the sealant mixture through an inner tubing, the inner tubing having at least one port disposed at a bottom end through which the first component is discharged downhole from the inner tubing. The method further includes pumping a second component of the sealant mixture through an annulus formed between an outer tubing disposed around the inner tubing, wherein the annulus delivers the second component of the sealant mixture downhole. The method further includes combining the first component of the sealant mixture and the second component of the sealant mixture in a mixing chamber formed between the bottom end of the inner tubing and a closed bottom end of the outer tubing, which extends below the bottom end of the inner tubing. And the method further includes discharging the sealant mixture from the mixing chamber into the void.

Another embodiment of the present invention includes a method of preparing a cement composition. The method includes mixing a first cementitious component and an aqueous-based fluid in a first mixer to form an intermediate cement composition. And the method further includes mixing the intermediate cement composition and a second cementitious component in a second mixer to form the cement composition.

The features and advantages of the present invention will be readily apparent to those skilled in the art upon a reading of the description of the preferred embodiments, which follows.

BRIEF DESCRIPTION OF THE DRAWINGS

A more complete understanding of the present disclosure and advantages thereof may be acquired by referring to the following description taken in conjunction with the accompanying drawings, which.

DESCRIPTION OF EXEMPLARY EMBODIMENTS

The present invention relates generally to apparatus and methods for sealing voids in a subterranean formation, and more particularly, the present invention relates to downhole tools that employ an outer tubing disposed around an inner tubing for placement of a sealant mixture into a void in a subterranean formation.

Figure 1:
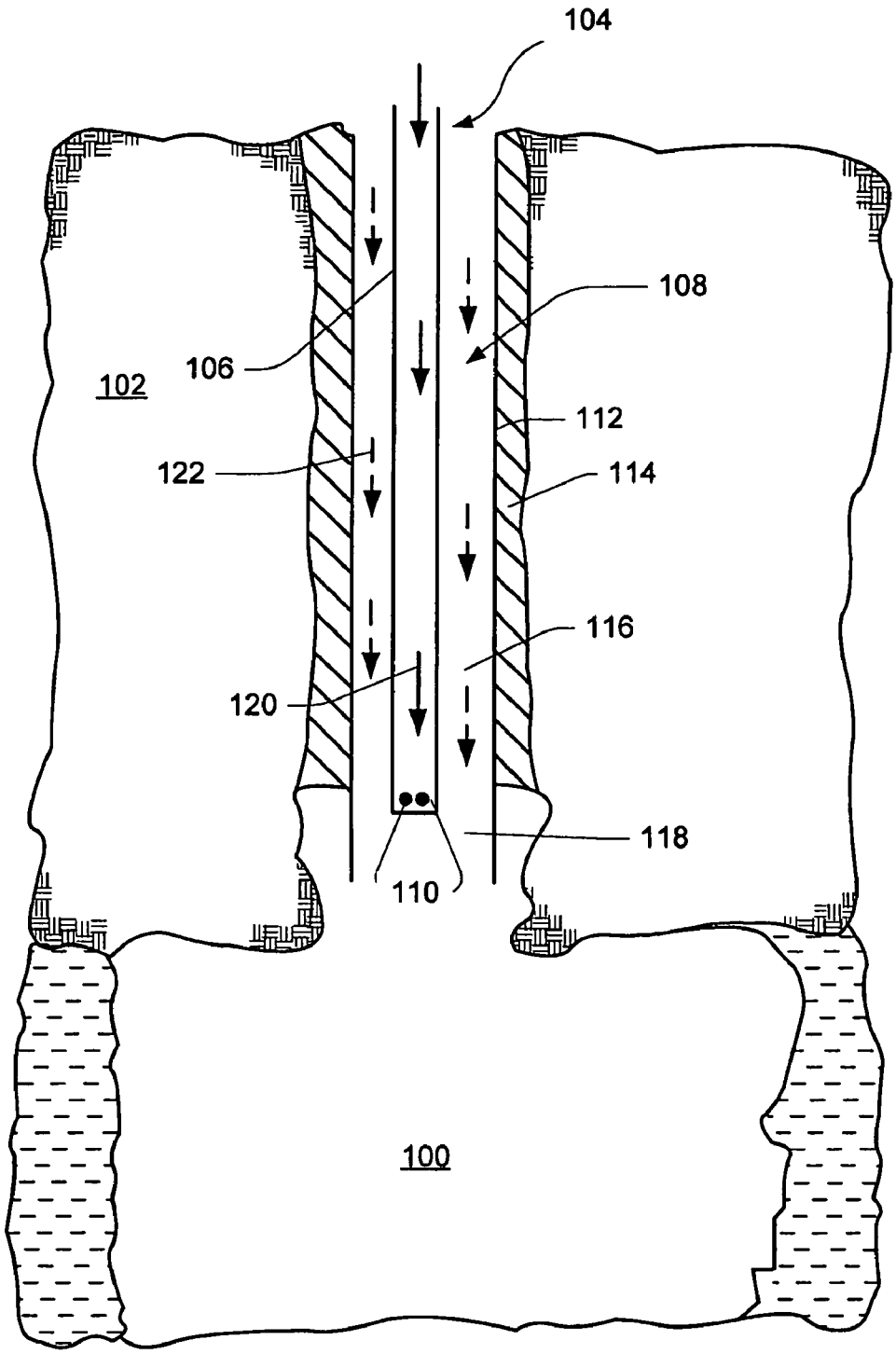
FIGURE 1 (PRIOR ART)
FIG. 1 is a cross-sectional view of a prior art technique for the delivery of a sealant mixture to a desired location in a subterranean formation.
Figure 2:
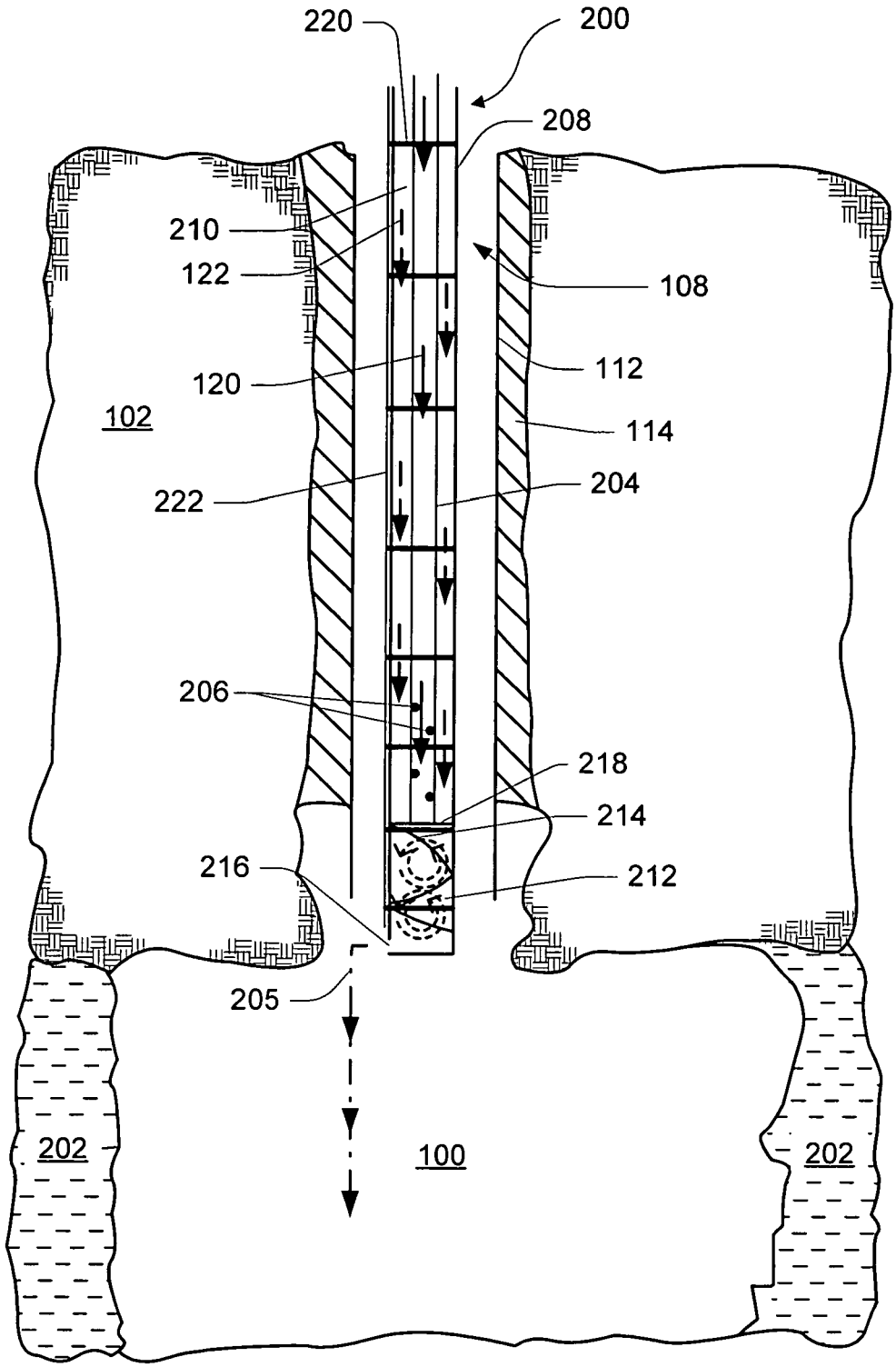
FIG. 2 is a cross-sectional view of a borehole having a downhole tool of the present invention disposed therein in accordance with an exemplary embodiment of the present invention.

The details of the present invention will now be described with reference to the accompanying figures. Referring now to FIG. 2, downhole tool 200 in accordance with the present invention is shown disposed in borehole 108 that penetrates subterranean formation 102. Borehole 108 is drilled into subterranean formation using conventional drilling techniques. In some embodiments, direct access to the desired location for the seal, e.g., void 100 in subterranean formation 102, may not be available so borehole 108 may be drilled through subterranean formation 102 into void 100 to provide access thereto. In other embodiments, access to void 100 may already be provided by a previously drilled borehole, e.g., borehole 108. As shown in FIG. 1, void 100 may be an underground mine shaft that penetrates coal seam 202. Those of ordinary skill in the art will appreciate that the desired location for the seal may be any of a wide variety of voids that may be found in a subterranean formation. Generally, borehole 108 should be lined with casing 112 that is cemented to subterranean formation by cement sheath 114, inter alia, to maintain borehole integrity. Casing 112 should have a sufficient inner diameter to allow manipulation of downhole tool 200 in borehole 108. Those of ordinary skill in the art will appreciate the circumstances when borehole 108 should or should not be cased and whether such casing should or should not be cemented. Indeed, the present invention does not lie in the performance of the steps of drilling borehole 108 or whether or not to case borehole 108, or if so, how. Even though FIG. 2 depicts borehole 108 as a vertical borehole, the apparatus and methods of the present invention may be suitable in generally horizontal, inclined, or otherwise formed portions of wells.

Downhole tool 200 includes inner tubing 204 through which first component 120 of sealant mixture 205 is delivered downhole. In some embodiments, inner tubing 204 is made of a ferrous metal. Generally, inner tubing 204 should have an outer diameter of at least about 1 inch. As one of ordinary skill in the art will appreciate, the size of the outer diameter may be varied depending upon a number of factors, including the amount of sealant mixture 205 to be delivered and the desired overall weight of downhole tool 200. The overall weight of downhole tool 200 should, inter alia, allow it to be rotated in borehole 108 and moved in and out of borehole 108.

At least one port is formed at a bottom end of inner tubing 204 through which first component of sealant mixture 205 exits inner tubing 204. In some embodiments, the at least one port is defined by a plurality of ports 206 disposed around a circumferential surface of the bottom end of inner tubing 204. Furthermore, the plurality of ports 206 may be placed in the bottom 1 to about 1.5 feet of inner tubing 204. In one certain embodiment (not shown), the at least one port is defined by an open bottom end. In another embodiment, inner tubing 204 may further comprise a bull plug (not shown) at the bottom end of inner tubing 204, wherein the at least one port is formed in the bull plug. As those of ordinary skill in the art will appreciate, the type, number, and size of the at least one port may be varied depending upon a number of factors, including the amount of first component 120 of sealant mixture 205 to be delivered and the desired rate at which first component 120 is to be delivered.

Downhole tool 200 further includes outer tubing 208 disposed around inner tubing 204, outer tubing 208 having a closed bottom end. Annulus 210 is formed between outer tubing 208 and inner tubing 204 through which second component 122 of sealant mixture 205 is delivered downhole. For reasons to be discussed below, the bottom end of outer tubing 208 should extend below the bottom end of inner tubing 204. In one embodiment, the bottom end of outer tubing 208 extends in the range of from about 1 to about 10 feet below the bottom end of inner tubing 204. In some embodiments, outer tubing 208 is made of a ferrous metal. Generally, outer tubing 208 should have an inner diameter of no greater than about 3.5 inches. As one of ordinary skill in the art will appreciate, the size of the inner diameter may be varied depending upon a number of factors, including the amount of sealant mixture 205 to be delivered and desired overall weight of downhole tool 200. As previously mentioned, the overall weight of downhole tool 200 should allow it to be rotated in borehole 108 and moved in and out of borehole 108. Furthermore, outer tubing 208 further comprises a plug at the bottom end of downhole tool 200. In one exemplary embodiment, the plug may be a bull plug (not shown).

Downhole tool 200 further includes mixing chamber 212 formed between the bottom end of inner tubing 204 and the bottom end of outer tubing 208 into which first component 120 and second component 122 combine to form sealant mixture 205. The size of mixing chamber 212 is defined by the distance the bottom end of outer tubing 208 extends beyond the bottom end of inner tubing 204. One skilled in the art will be able to determine, with the benefit of this disclosure, the appropriate size of mixing chamber 212 based on a number of factors, including the amount of the sealant mixture to be delivered and the inner diameter of inner tubing 204 and outer tubing 208. Furthermore, to aid in the mixing, downhole tool 200 may further include static mixer 214 in mixing chamber 212. As those of ordinary skill in the art will appreciate, any number of static mixers (e.g., helical mixing elements) may be employed as well as other means to aid the mixing of sealant mixture 205.

Outer tubing 208 should further include at least one discharge port 216 formed at the bottom end of outer tubing 208 for discharging sealant mixture 205 from mixing chamber 212. In one embodiment, at least one discharge port 216 is defined by a slot at the bottom end of outer tubing. In another embodiment, at least one discharge port 216 defined by a plurality of holes (not shown) at the bottom end of outer tubing 208. In yet another embodiment, at least one discharge port 216 may be formed in a bull plug, that may be included at the bottom end of outer tubing 208. As those of ordinary skill in the art will appreciate, the type, number, and size of the at least one discharge port may be varied depending upon a number of factors, including the amount of sealant mixture to be delivered, the location for delivery of sealant mixture 205, and the desired rate at which sealant mixture 205 is to be delivered.

Downhole tool 200 may further include stop 218 attached inside outer tubing 208. The bottom end of inner tubing 204 may rest on stop 218, thereby allowing outer tubing 208 to extend beyond inner tubing 204 and define mixing chamber 212. In one embodiment, stop 218 may be placed in outer tubing 208 in the range of about 1 to about 10 feet from the bottom end of outer tubing 208. Furthermore, stop 218 should have an opening so that first component 120 and second component 122 may pass through stop 218 and into mixing chamber 212.

Figure 3:
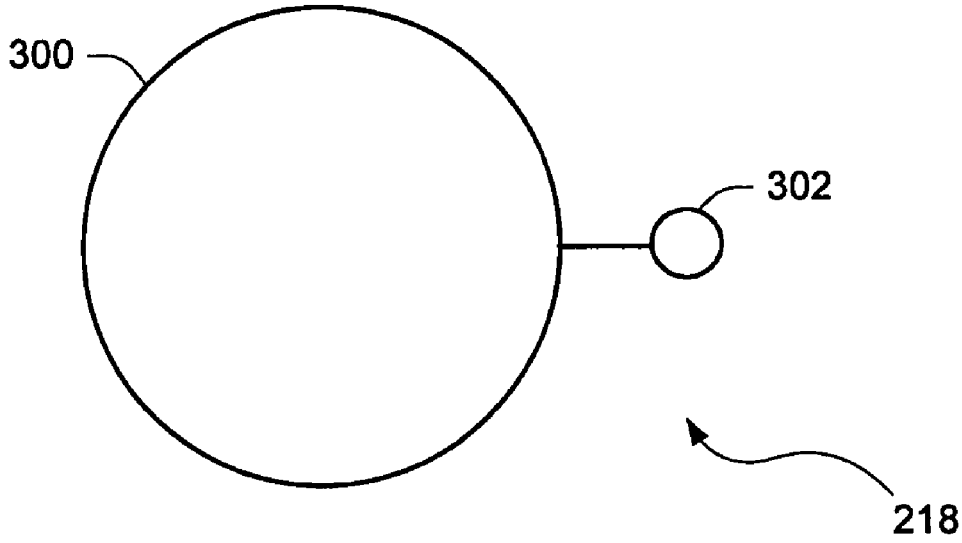
FIG. 3 is a top view of a latch ring apparatus in accordance with an exemplary embodiment of the present invention.

Downhole tool 200 may further comprise a means for orientating downhole tool in borehole 108. In one exemplary embodiment, the orientation means includes at least one latch ring assembly 220 attached to outer tubing 208 and rod 222 attached to the at least one latch ring assembly 220. A top view of one latch ring assembly 220 is shown in FIG. 3. At least one latch ring assembly 220 may comprise large latch ring 300 for attachment to outer tubing 208, and small latch ring 302 attached to large latch ring 300. Large latch ring 300 may be integrally formed with outer tubing 208 or attached to outer tubing 208 by known securing techniques. For instance, large latch ring 300 may be tack welded on the joints of outer tubing 208.

Rod 222 may be inserted into small latch ring 302 of at least one latch ring assembly 220. Rod 222 should be held in place by small latch ring 302 of at least one latch ring assembly 220. Rod 222 should extend from at or above the top end of downhole tool 200 to the top edge of discharge port 216. When downhole tool 200 is placed in borehole 108, rod 222 should extend above the ground surface (not shown). In one certain embodiment, rod 222 is formed from a ferrous material. Generally, rod 222 should have an outer diameter in the range of from about 0.25 to about 0.75 inches. An advantage of rod 222 is that rod 222 may be used as a surface indicator for the orientation of discharge port 216 in borehole 108 so that the location for the delivery of sealant mixture 205 in subterranean formation 102 may be controlled from above the ground surface. For example, rod 222 may be aligned with marks on a plate (not shown) that may be placed at the surface, wherein these marks on the plate correspond with the desired location for the seal, e.g., void 100 in subterranean formation 102.

In operation, downhole tool 200 should be placed into borehole 108 and orientated therein so that sealant mixture 205 may be delivered to the desired location for the seal, e.g., void 100 in subterranean formation 102. As one of ordinary skill in the art will appreciate, any number of means may be used to place downhole tool 200 in borehole 108. For example, a crane or workover rig may be used to raise and lower downhole tool 200 in borehole 108. After downhole tool 200 has been placed within borehole 108 as desired, it should be orientated within borehole, such as by using rod 222, to ensure delivery of sealant mixture 205 to the desired location. Once downhole tool 200 has been orientated within borehole 108 as desired, first component 120 and second component 122 may be delivered downhole. First component 120 may be delivered down through inner tubing 204, out through ports 206, and into mixing chamber 212. Second component may be delivered down through annulus 210 between inner tubing 204 and outer tubing 208 into mixing chamber 212. In mixing chamber 212, the two components combine to form sealant mixture 205. After mixing, sealant mixture 205 is forced out at least one discharge port 216 for delivery to void 100. Once delivered, sealant mixture 205 hardens to form a seal. An advantage of delivering sealant mixture 205 to void 100 using downhole tool 200 is that precise placement of sealant mixture 205 in the desired location may be achieved. As a result, the amount of sealant mixture 205 needed to form a seal may be reduced. Further, precise placement of sealant mixture 205 may allow reuse of borehole 108 after the process is completed.

The sealant mixture used in the present invention may be any of a wide variety of sealant mixtures commonly used to form seals in subterranean operations. Preferably, the sealant mixture is a substantially non-flowable cement composition. An example of a suitable substantially non-flowable cement composition is described in U.S. Pat. No. 5,577,865, the disclosure of which is hereby incorporated by reference.

The sealant mixture of the present invention should be used as a two component system, wherein the two components are mixed downhole to form the sealant mixture. Generally, the sealant mixture comprises a first component and a second component. In some embodiments, such as where the sealant composition is a substantially non-flowable cement composition, the first component may comprise an activator, and the second component may comprise a flowable cement composition. Alternatively, the first component may comprise the flowable cement composition, and the second component may comprise the activator. Among other things, when the activator is mixed with the flowable cement composition, a rapid gelation reaction occurs forming a substantially non-flowable cement composition.

The activator may be any of a wide variety of suitable activators for forming the desired sealant mixture. Examples of suitable activators include, but are not limited to, aqueous solutions comprising sodium silicate, triethanolamine, sodium meta-silicate, sodium aluminate, calcium chloride, and ammonium chloride. Of these, sodium silicate is preferred. Generally, the activator should be delivered downhole in an amount sufficient to provide the desired gelation reaction. In some embodiments, the activator may be delivered downhole in an activator-to-flowable cement composition ratio in the range of from about 1:1 to about 1:15 by volume. As those skilled in the art will appreciate this ratio will vary depending on a number of factors, including the concentration of the activator.

The flowable cement compositions generally may comprise an aqueous-based fluid and one or more cementitious materials. Further, the flowable cement compositions may be foamed or unfoamed or may comprise other means to vary their densities.

The aqueous-based fluid may be fresh water, salt water (e.g., water containing one or more salts dissolved therein), brine (e.g., saturated salt water), seawater, or any other aqueous liquid that does not adversely react with other components used in accordance with this invention. The aqueous-based fluid should be included in the flowable cement composition in an amount sufficient to form a pumpable slurry. In some embodiments, the aqueous-based fluid is included in the flowable cement composition in an amount in the range of from about 20% to about 80% by weight of the cementitious materials ("bwoc"). In other embodiments, the aqueous-based fluid is included in the flowable cement composition in an amount in the range of from about 20% to about 40% bwoc.

Generally, any cementitious materials suitable for use in subterranean applications are suitable for use in the present invention. In one embodiment, the cementitious materials may comprise hydraulic cement. A variety of hydraulic cements are suitable for use, including those comprised of calcium, aluminum, silicon, oxygen, and/or sulfur, which set and harden by reaction with water. Such hydraulic cements include, but are not limited to, Portland cements, pozzalonic cements, gypsum cements, calcium phosphate cements, high alumina content cements, silica cements, high alkalinity cements, and mixtures thereof. In some embodiments, the cementitious material include hydraulic cement and filler materials, such as fly ash. An example of a suitable fly ash is ASTM Class F fly ash POZMIX® cement. Preferably, the fly ash, when used, is included in the cementitious material in an amount of about 50% of fly ash by weight of the cementitious material. As will be appreciated by those of ordinary skill in the art, other ratios and grades of fly ash may be used as well as other cementitious materials. Furthermore, the higher the class of fly ash used, the less hydraulic cement and activator may be required.

Generally, the flowable cement compositions of the present invention may be prepared by any suitable method. In some embodiments, the one or more cementitious materials should be dry blended prior to mixing with the aqueous-based fluid to prepare the flowable cement composition. In some instances, however, dry blending the one or more cementitious materials may not be feasible. In these embodiments, the flowable cement compositions may be prepared on the job site in a very rapid manner (e.g., "on the fly"). Where prepared on the fly, a first cementitious material, such as fly ash, and a second cementitious material, such as hydraulic cement, should be delivered to the job site and stored separately. Alternatively, the first cementitious material may be hydraulic cement, and the second cementitious material may be fly ash. Next, the first cementitious component should be mixed in a first mixer with the aqueous-based fluid to form an intermediate cement composition. The entire requirement of the aqueous-based fluid should be mixed with the first cementitious component in the first mixer. During mixing, the properties of the intermediate cement composition may be monitored using known monitoring techniques, such as radioactive densometers. Preferably, the first mixer is a high energy mixer, such as that commercially available from Halliburton Energy Services, Duncan Okla., under part no. 439.00279. Next, the second cementitious component should be mixed with the intermediate cement composition in a second mixer to form the flowable cement composition. Preferably, the second mixer is a high energy mixer, such as that commercially available from Halliburton Energy Services, Duncan Okla., under part no. 439.00279. During mixing and/or prior to being pumped downhole, the properties of the flowable cement composition may be monitored using known monitoring techniques, such as radioactive densometers. After mixing, the flowable cement composition may be pumped downhole, such as by using high-pressure pumps. Furthermore, the flowable cement composition may be foamed, such as by adding air or nitrogen, downstream of the high-pressure pumps. As previously discussed the flowable cement composition may either be first component 120 delivered downhole through inner tubing 204, or it may be second component 122 delivered downhole through annulus 210 formed between inner tubing 204 and outer tubing 208. By utilizing this method for preparation of the flowable cement composition, the properties of the flowable cement composition may be adjusted as needed during subterranean operations. This method for preparation of the flowable cement compositions may be useful in a variety of applications where multiple cementitious components may be incorporated into a flowable cement composition, including preparation of the flowable cement compositions for use in the downhole tools of the present invention.

Similarly, another mixer may be used to prepare the activator prior to it being delivered downhole. In some embodiments, this may be necessary where concentrated solutions of the activator are delivered to the job site. In these embodiments, this mixer may be used to dilute the concentrated solution of the activator to the required concentration for the particular application. In other embodiments, however, dilution may not be necessary where the desired concentration of the activator is available for use. After preparation, the activator may be pumped downhole, such as by using high-pressure pumps. It is within the ability of one of ordinary skill in the art, with the benefit of this disclosure, to determine the required concentration of the activator depending on a number of factors, including, the activator chosen and the composition of the flowable cement composition.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alteration, and equivalents in form and function as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A downhole tool for sealing a void in a subterranean formation comprising:

an inner tubing formed from a material comprising a ferrous metal and having at least one port disposed at a bottom end through which a first component of a sealant mixture is delivered downhole;

an outer tubing disposed around the inner tubing thereby forming an annulus therebetween through which a second component of the sealant mixture is delivered downhole, the outer tubing having a closed bottom end, which extends below the bottom end of the inner tubing;

a mixing chamber formed between the bottom end of the inner tubing and the bottom end of the outer tubing into which the first and second components of the sealant mixture combine to form the sealant mixture; and at least one discharge port formed at the bottom end of the outer tubing for discharging the sealant mixture from the mixing chamber.

2. The downhole tool of claim 1 wherein the at least one port in the inner tubing is defined by an open bottom end.

3. The downhole tool of claim 1 wherein the at least one port in the inner tubing is defined by a plurality of ports disposed around a circumferential surface of the bottom end of the inner tubing.

4. The downhole tool of claim 1 wherein the inner tubing comprises a bull plug at the bottom end of the inner tubing.

5. The downhole tool of claim 1 further comprising a large latch ring for attachment to the outer tubing and a small latch ring attached to the large latch ring.

6. The downhole tool of claim 5 further comprising a rod inserted into the small latch ring, which extends from at least a top end of the downhole tool to a top edge of the at least one discharge port in the outer tubing, wherein the rod orientates the downhole tool in a borehole.

7. The downhole tool of claim 1 further comprising a stop, which is attached inside the outer tubing and is a rest for the bottom end of the inner tubing.

8. The downhole tool of claim 1 wherein the downhole tool further comprises a static mixer in the mixing chamber, which aids in mixing the first component and second component in the mixing chamber.

9. The downhole tool of claim 1 wherein the outer tubing comprises a bull plug at the bottom end of the outer tubing.

10. The downhole tool of claim 1 wherein the first component of the sealant mixture comprises an activator.

11. The downhole tool of claim 1 wherein the first component of the sealant mixture comprises a flowable cement composition.

12. The downhole tool of claim 1 wherein the second component of the sealant mixture comprises a flowable cement composition.

13. The downhole tool of claim 1 wherein the second component of the sealant mixture comprises an activator.

14. The downhole tool of claim 1 wherein the sealant mixture comprises a substantially non-flowable cement composition.

15. A downhole tool for sealing a void in a subterranean formation comprising:

an inner tubing having at least one port disposed at a bottom end through which a first component of a sealant mixture is delivered downhole;

an outer tubing disposed around the inner tubing thereby forming an annulus therebetween through which a second component of the sealant mixture is delivered downhole, the outer tubing having a closed bottom end, which extends below the bottom end of the inner tubing;

a mixing chamber formed between the bottom end of the inner tubing and the bottom end of the outer tubing into which the first and second components of the sealant mixture combine to form the sealant mixture;

at least one discharge port formed at the bottom end of the outer tubing for discharging the sealant mixture from the mixing chamber; and means for orientating the downhole tool in a borehole.

16. The downhole tool of claim 15 wherein the at least one port in the inner tubing is defined by an open bottom end.

17. The downhole tool of claim 15 wherein the at least one port in the inner tubing is defined by a plurality of ports disposed around a circumferential surface of the bottom end of the inner tubing.

18. The downhole tool of claim 15 wherein the inner tubing comprises a bull plug at the bottom end of the inner tubing.

19. The downhole tool of claim 15 wherein the means for orientating the downhole tool in the borehole comprises a large latch ring attached to the outer tubing, a small latch ring attached to the large latch ring, and a rod inserted into the small latch ring, the rod extending from at least a top end of the downhole tool to a top edge of the at least one discharge port in the outer tubing.

20. The downhole tool of claim 15 further comprising a stop, which is attached inside the outer tubing and is a rest for the bottom end of the inner tubing.

21. The downhole tool of claim 15 wherein the downhole tool further comprises a static mixer in the mixing chamber, which aids in mixing the first component and second component in the mixing chamber.

22. The downhole tool of claim 15 wherein the outer tubing comprises a bull plug at the bottom end of the outer tubing.

23. The downhole tool of claim 15 wherein the first component of the sealant mixture comprises an activator.

24. The downhole tool of claim 15 wherein the first component of the sealant mixture comprises a flowable cement composition.

25. The downhole tool of claim 15 wherein the second component of the sealant mixture comprises a flowable cement composition.

26. The downhole tool of claim 15 wherein the second component of the sealant mixture comprises an activator.

27. The downhole tool of claim 15 wherein the sealant mixture comprises a substantially non-flowable cement composition.

28. A method of sealing a void in a subterranean formation comprising the steps of:

pumping a first component of a sealant mixture through an inner tubing, the inner tubing having at least one port disposed at a bottom end through which the first component is discharged downhole from the inner tubing;

pumping a second component of the sealant mixture through an annulus formed between an outer tubing disposed around the inner tubing, wherein the annulus delivers the second component of the sealant mixture downhole;

combining the first component of the sealant mixture and the second component of the sealant mixture in a mixing chamber formed between the bottom end of the inner tubing and a closed bottom end of the outer tubing, which extends below the bottom end of the inner tubing; and discharging the sealant mixture from the mixing chamber into the void.

29. The method of claim 28 further comprising the steps of:

mixing a first cementitious component and an aqueous-based fluid in a first mixer to form an intermediate cement composition; and mixing the intermediate cement composition and a second cementitious component in a second mixer to form the second component of the sealant mixture.

30. The method of claim 28 further comprising the steps of:

mixing a first cementitious component and an aqueous-based fluid in a first mixer to form an intermediate cement composition; and mixing the intermediate cement composition and a second cementitious component in a second mixer to form the first component of the sealant mixture.

31. A method of sealing a void in a subterranean formation comprising the steps of:

providing a first component of a sealant mixture comprising an activator;

mixing a first cementitious component and an aqueous-based fluid in a first mixer to form an intermediate cement composition;

mixing the intermediate cement composition and a second cementitious component in a second mixer to form a second component of the sealant mixture;

pumping the first component of the sealant mixture through an inner tubing, the inner tubing having at least one port disposed at a bottom end through which the first component is discharged downhole from the inner tubing;

pumping the second component of the sealant mixture through an annulus formed between an outer tubing disposed around the inner tubing, wherein the annulus delivers the second component of the sealant mixture downhole, combining the first component of the sealant mixture and the second component of the sealant mixture in a mixing chamber formed between the bottom end of the inner tubing and a closed bottom end of the outer tubing, which extends below the bottom end of the inner tubing; and discharging the sealant mixture from the mixing chamber into the void.

32. The method of claim 31 further comprising the step of monitoring the properties of the intermediate cement composition.

33. The method of claim 31 further comprising the step of monitoring the properties of the second component of the sealant mixture.

34. The method of claim 31 wherein the first cementitious component is a fly ash.

35. A method of sealing a void in a subterranean formation comprising the steps of:

mixing a first cementitious component and an aqueous-based fluid in a first mixer to form an intermediate cement composition;

mixing the intermediate cement composition and a second cementitious component in a second mixer to form a first component of a sealant mixture;

pumping the first component of the sealant mixture through an inner tubing, the inner tubing having at least one port disposed at a bottom end through which the first component is discharged downhole from the inner tubing;

pumping a second component of the sealant mixture through an annulus formed between an outer tubing disposed around the inner tubing, wherein the annulus delivers the second component of the sealant mixture downhole, combining the first component of the sealant mixture and the second component of the sealant mixture in a mixing chamber formed between the bottom end of the inner tubing and a closed bottom end of the outer tubing, which extends below the bottom end of the inner tubing; and discharging the sealant mixture from the mixing chamber into the void.

36. The method of claim 35 further comprising the step of monitoring the properties of the intermediate cement composition.

37. The method of claim 35 further comprising the step of monitoring the properties of the first component of the sealant mixture.

38. The method of claim 35 wherein the first cementitious component is a fly ash.

* * * * *